US005855171A

United States Patent [19]

McManamon et al.

[11] Patent Number: 5,855,171

[45] Date of Patent: Jan. 5, 1999

[54] PRINTING MACHINES

[76] Inventors: David McManamon, Ingle Cottage, Walker Lane, Fulwood; Stephen McManamon, Ingle Cottage, Walker Lane, Fulwood, both of Preston, United Kingdom

[21] Appl. No.: 964,365

[22] Filed: Nov. 4, 1997

Related U.S. Application Data

[63] Continuation of Ser. No. 325,374, Dec. 22, 1994, abandoned.

[51] Int. Cl.[6] ..... B41F 31/08; B41F 35/04

[52] U.S. Cl. ..... 101/364; 101/366; 101/483

[58] Field of Search ..... 101/364, 350.1, 101/363, 207–210, 148, 483; 347/35; 222/148, 149, 151; 203/4; 118/302

[56] References Cited

U.S. PATENT DOCUMENTS

| | | | |
|---|---|---|---|
| 5,343,805 | 9/1994 | Louenbrant | 101/366 |

FOREIGN PATENT DOCUMENTS

| | | |
|---|---|---|
| 338 209 | 8/1977 | Austria . |
| 338209 | 8/1977 | Austria . |
| 0368 485 | 5/1990 | European Pat. Off. . |
| 0 382 347 | 8/1990 | European Pat. Off. . |
| 0 513 546 A1 | 11/1992 | European Pat. Off. . |
| 0 523 989 | 1/1993 | European Pat. Off. . |
| 2 258 845 | 2/1993 | United Kingdom . |

*Primary Examiner*—J. Reed Fisher

*Attorney, Agent, or Firm*—Townsend and Townsend and Crew LLP

[57] ABSTRACT

A method and apparatus are proposed for cleaning the ink chamber (27) of the ink rail (11) of a printing machine ink supply system and from whch ink is delivered to an ink roller through a multiplicity of side-by-side stepped feed holes (29) in the rail (11), the method and apparatus utilising a plug (41) freely slidable within the chamber (27) and adapted to purge the chamber (27) of ink present in advance of the plug (41) on its movement longitudinally of the chamber. In analogous manner the plug (41) may be used to effect a colour change as between ink sources provided at opposite ends of the rail. (FIG. 2).

6 Claims, 3 Drawing Sheets

PRINTING MACHINES

This is a continuation of application Ser. No. 08/325,374, filed Dec. 22, 1994, now abandoned, the disclosure of which is incorporated by reference.

The invention concerns improvements in or relating to printing machines, and has more particular reference to the cupply of ink or other fluid, hereinafter referred to simply as ink if the context so permits, to the printing roller thereof.

In the printing art, on colour change the need exists not only to replace one ink supply with another but also to remove ink of the previous colour from the various feed passages between the ink supply and the printing roller and to clean such passages. Conventional practice is to discard any residual ink and to flush out the relevant passages with an appropriate cleaning material. Not only does such practice give rise to a significant machine down time but the discarded ink represents a financial loss of substantial proportions.

In GB-A-2258845 there is disclosed a means for supplying ink to a printing roller of a printing machine, the means including an elongate ink rail, an ink chamber in said rail and extending in the longitudinal direction thereof, a multiplicity of spaced parallel feed passages in said rail having respective outlet orifices at a common surface of said rail, the feed passages extending between said common surface and the said ink chamber, and means controlling the flow of ink to the feed passages.

The object of the present invention is to provide a means whereby ink supply means, particularly though not exclusively an ink or fluid supply means an aforesaid, night be cleaned in a ready and efficient manner, without the need to discard residual ink present at colour change.

According to one aspect of the present invention there is proposed a method of cleaning and/or recovering ink from the ink supply means of a printing machine on colour change, the ink supply means including an elongate chamber defining an ink reservoir to which ink is fed from a supply and from which ink is delivered to the printing roller, the method including the steps of providing a plug of a transverse cross-section corresponding to that of the elongate chamber, the plug being a close but sliding fit within the chamber, and moving said plug longitudinally of the said chamber to purge said chamber of ink and, preferably, to return said ink to the said supply.

According to another aspect of the invention there is proposed a method of effecting colour change in the ink supply system of a printing machine, the ink supply system including an elongate chamber defining an ink reservoir to which ink is fed from a supply and from which ink is delivered to the printing roller, ink being supplied to the opposite ends of the elongate chamber from respective differently coloured supplies thereof, the method including the steps of providing a plug within the chamber, the plug being a close but sliding fit therein, and moving the plug longitudinally of the chamber to purge the chamber of the redundant colour and allow feed to the said chamber of the replacement colour.

According to a preferred feature, the plug is moved longitudinally of the elongate chamber by feed pressure applied to the replacement ink.

It is to be appreciated that, whilst in the case of colour change the plug will traverse the full length of the elongate chamber, it is contemplated that by moving the plug through a part only of the length of the chamber such chamber can operate to deliver ink of a given colour to a respective part of the printing roller and ink of a different colour to the balance of the chamber.

Indeed, it may be possible, subject to the provision of suitable locking means, for example magnetic, to provide multiple plugs whereby the elongate chamber might be divided into individual sections each delivering ink of a respective colour to a respective axial extent of the printing roller, shift of the plugs being effected by the pressure of thy incoming ink, any necessary provision being made to supply ink to an intermediate section of the chamber.

The invention also includes apparatus for practising the method as aforesaid, and, according to a further aspect of the present invention there is proposed an ink supply system for a printing machine, tho system including an elongate ink fall, an ink chamber in said ink rail and extending in the longitudinal direction thereof, a multiplicity of parallel feed passage in said rail having respective outlet orifices at a common surface of said rail, the feed passages extending between said common surface and said chamber, characterised by a plug within said chamber as a close fit therein, the plug being movable longitudinally of said chamber.

The invention will now be described further, by way of example only, with reference to the accompanying diagrammatic drawings illustrating two embodiment thereof said in which.

Figure 1:
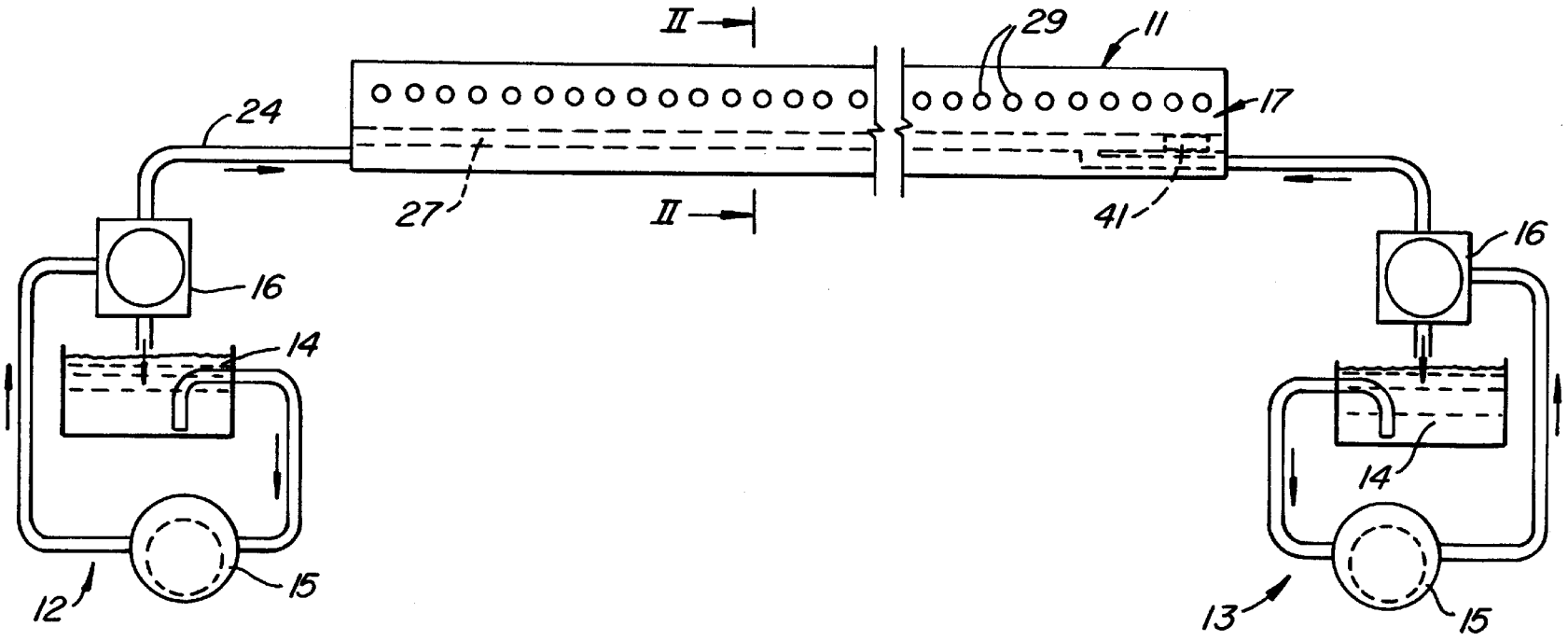
FIG. 1 is a diagrammatic front elevation of an arrangement for supplying ink to the printing roller of a newspaper printing machine.

Referring now to the drawings, and particularly to FIG. 1 thereof, an ink supply arrangement for a printing machine comprises an ink rail 11 of a length in excess of the intended printing width and feed means 12, 13 for supplying ink to the respective ends of the rail, each feed means 12, 13 including an ink reservoir 14, a positive displacement pump 15 and a density control valve 16 to which ink from the reservoir 14 is fed by the pump 15 and from which ink is supplied to the rail 11.

Figure 2:
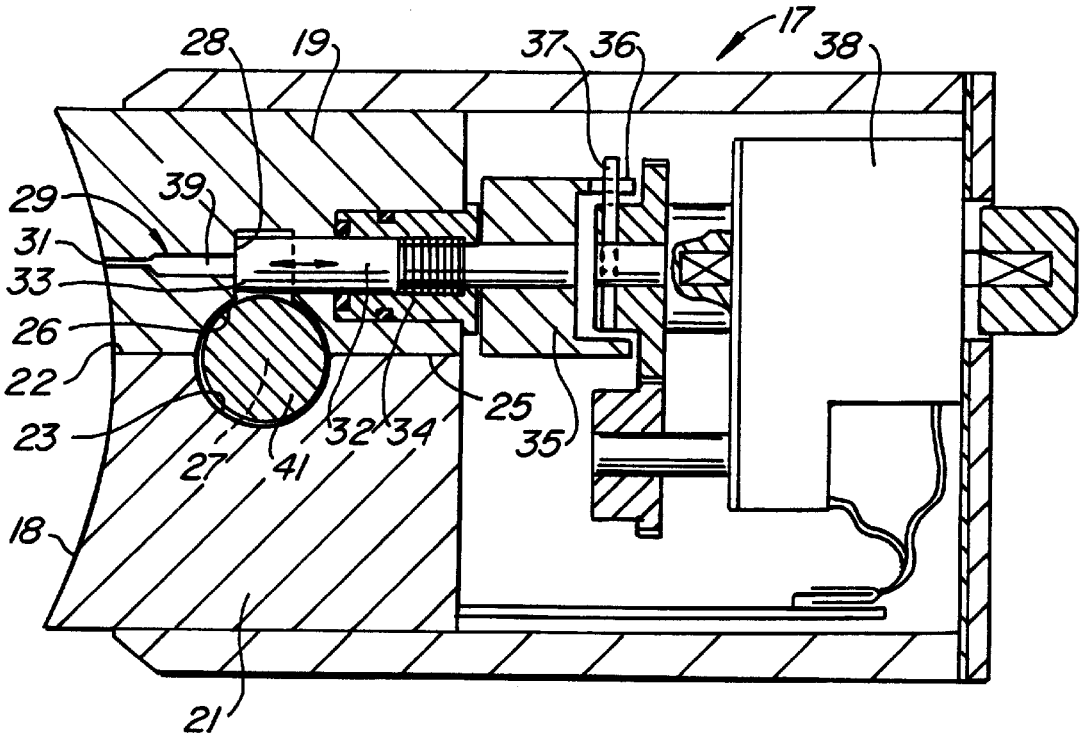
FIG. 2 is A section on line II—II of FIG. 1.

The ink rail 11, see now FIG. 2, comprises an elongate, generally rectangular body 17, that face 18 of the body 17 intended for disposition in closely spaced opposed relationship with the roller (not shown) to which the ink is to be applied being of concave, part-cylindrical form of a curvature approximating to that of the said roller. The body 17 is conveniently of aluminium and is split along its horizontal centre line to give upper and lower body parts 19, 21.

The upper face 22 of the lower body part 21 includes a channel 23 of semi-circular transverse cross section to which ink is fed from the density control valve 16 through feed pipe 24.

The lower face 25 of the upper body part 19 has a channel 26 of like semi-circular transverse cross section to that provided in the lower body part 21, the channels 23, 26 in the respective body parts being arranged in superimposed register to define a circular ink chamber 27 in the body. In contra-distinction to the lower body part 21, the upper body part 19 further includes a groove 28 longitudinally thereof and as an extension of the channel 26 into the body part, the groove 28 being of rectangular transverse cross section and being for a purpose hereafter to be made apparent.

A multiplicity of stepped holes 29 is provided in side-by-side disposition in the upper body part, the said holes extending parallel to the lower face 25 of said body part and throughout the full extent thereof. The stepped holes 29 are so positioned as to pass through and transversely of the groove 28 and are each such as to provide an outer section, an intermediate section and an inner section of successively reducing diameters.

That part of the concave face 18 provided by the upper body part 19 is slotted in register with the inner section 31 of each stepped hole, the slots (not shown) preferably being of arcuate section when considered in the longitudinal direction thereof with the slots of the successive stepped holes 29 being in alignment longitudinally of the body part and merging one with another to give a continuous slot at the surface of the body part of cyclically varying depth.

Each stepped hole 29 receives a cylindrical key 32 into engagement therewith, the key 32 being movable axially of the stepped hole and being engageable with a flank 33 of the groove 29. The key is mounted in a bush 34 seated in sealed relationship in the outer section of a respective stepped hole 29 and is screw-threadedly engaged therewith so as to be movable to or from engagement with the said flank 33. The bush 34 has an hexagonal flange at its outer end which seats against the upper body part lo, thereby to ensure accuracy of location of the bush 34 axially of the stepped hole 29. Outwardly of the bush the key 32 is secured to cylindrical collar 35 of sleeve-like form, there being a control slot 36 in the annular end face of the collar 35 to receive a radial pin 37 carried by a displacement means 38.

The displacement means 18 consists of a stepping motor, moving in 200 increments per revolution, drivingly connected with the key 32, whereby the key 32 is rotated for selective adjustment longitudinally of the bush 34, and thus relative to the step formed by flank 33, thereby to vary the cross-sectional dimensions of the flow passage between channel 27 and the inner section 39 of the stepped hole 29.

In use, ink is delivered to the ink chamber 27 in the ink rail 11 from one or other feed means 12, 13 by the relevant positive displacement pump 15, a proportion of the ink delivered by such pump 15 passing to the chamber 27 and the balance returned to the reservoir 14 according to the setting of the density control valve 16.

Ink fed to the ink chamber 27 fills such chamber from the bottom, and thus no ink can be applied to the roller until such chamber is full and the ink therein is under pressure.

From the ink chamber 27 ink passes to the roller through the inner section 39 of the respective stepped holes 29 in the upper body part 19, the rate of feed at each position being variable according to the position of the respective key 32 relative to the adjacent end of such inner hole section.

As will be appreciated, each key is individually controllable as to rate of feed according to the setting of that key whilst the rate of delivery of the ink rail as a whole, and thus from the keys considered collectively, is variable by adjustment of the shuttle valve member.

Thus fat the structure is in accordance with the disclosure of the prior application aforesaid.

Figure 3:
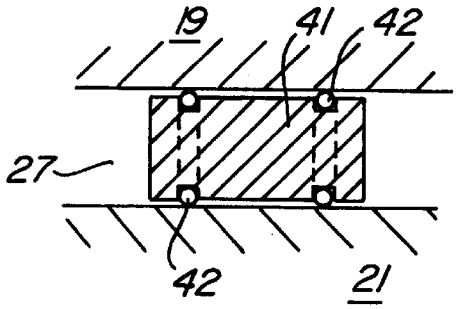
FIG. 3 is an enlarged sectional elevation showing the plug in position within the ink chamber.

The present invention contemplates the provision of a plug within the ink chamber for controlled movement longitudinally thereof, the plug 41 being of cylindrical form and being a close but sliding fit within the chamber 27. The plug is grooved at its cylindrical surface to receive O-rings 42 into engagement therewith, as shown in FIG. 3, the said O-rings serving to provide a seal between the plug and the opposing cylindrical surface of the chamber.

Assuming that inks of different respective colours are provided in the reservoirs at the respective ends of the rail, the plug is located at one end of the ink chamber, being that and remote from the feed means in use, and serves to isolate the ink of the respective feed means 12, 13. If it is required to effect a colour change, the plug is moved longitudinally of the ink chamber under the effect of the line pressure of the replacement ink, the plug purging the chamber of ink present therein and returning such ink to the now non-effective feed means. It has been found that the effective seal between the plug and chamber surface provided by the O-rings not only maintains the ink of the two feed means in mutual isolation, but the O-rings remove ink from the surface of the chamber, and avoid contamination of the incoming ink.

Any ink present in the stepped holes 29, which ink is of only minimal quantity, is discharged by the new ink at the onset of printing, and in practical terms there is no contamination of the replacement colour ink after initial operation of the printing press with the replacement colour ink.

It is to be appreciated that means, for example magnetic means, may be provided to locate the plug at a position intermediate the ends of the chamber, so as effectively to provide the facility for delivering ink of two different colours to the respective sides of the printing machine, the two colours being isolated by the plug.

As a further development, several plugs may be utilised simultaneously to divide the ink chamber into a corresponding number of sections each fed with ink of a requisite colour and in an appropriate manner.

If it is required to provide a facility for cleaning the ink chamber, and indeed also the printing press, with appropriate cleaning fluids, ink is purged from the chamber in analogous manner to that mentioned above, but instead of effecting movement of the plug by utilising the line pressure of the incoming ink, a supply of cleaning fluid will be connected with the chamber and the pressure of that fluid can be used to move the plug. The cleaning fluid will pass through the stepped holes and onto the printing roll, or indeed any intermediate transfer rolls, passing through the printing machine in like manner to ink and being available for application to the printing roll so as to clean the same.

Figure 4A:
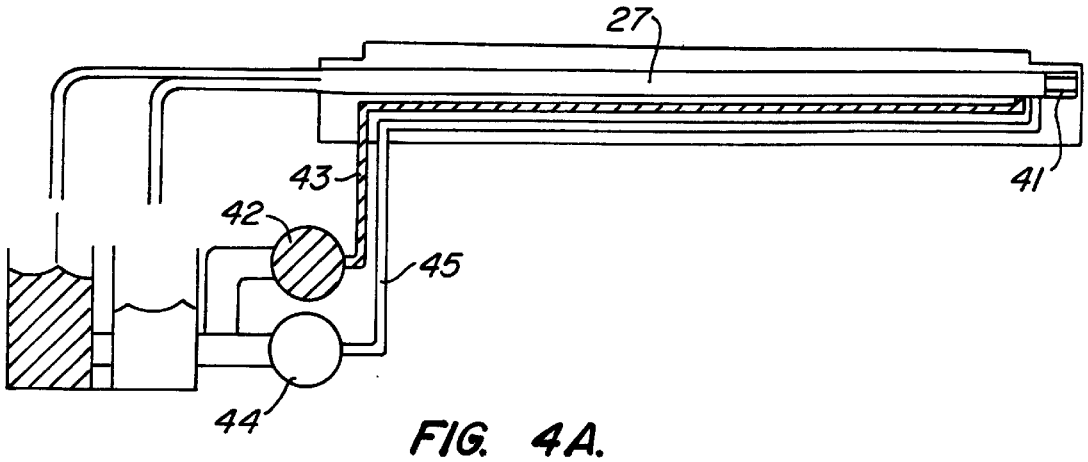
FIGS. 4*a* to 4*c* show, in diagrammatic side elevation an alternative arrangement and the successive steps in cleaning the arrangement and effecting colour change.
Figure 4B:
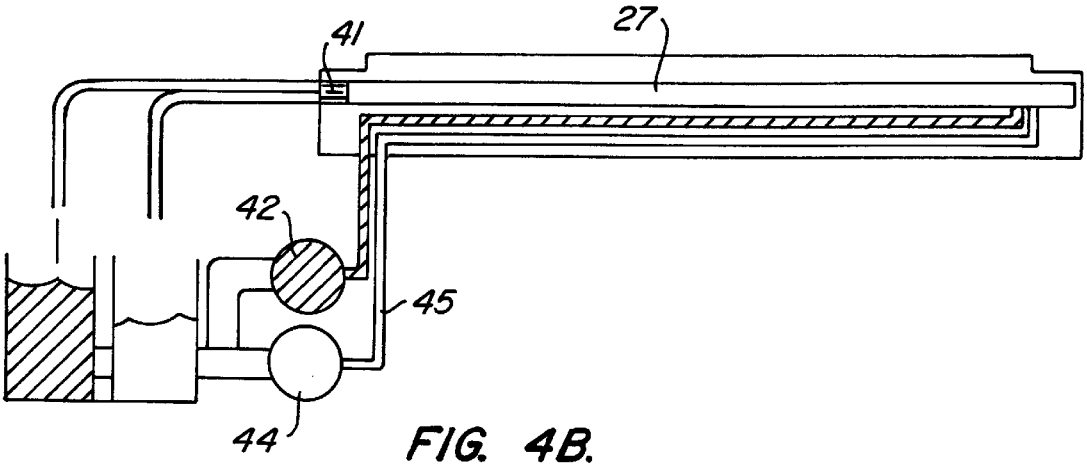
Figure 4C:
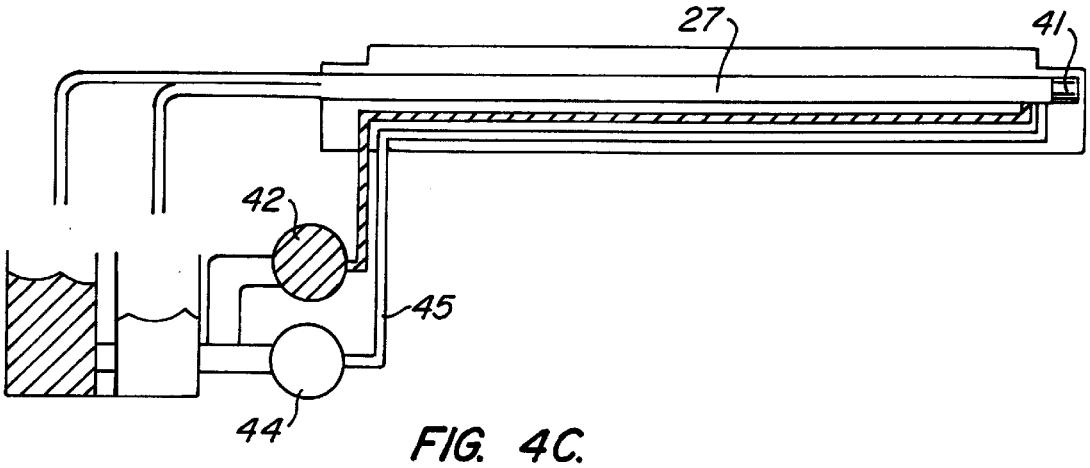

An alternative arrangement and sequence of operations for cleaning and colour change is shown in FIGS. 4*a* to 4*c*.

Referring now to FIG. 4*a*, and proceeding on the basis that the chamber 27 in initially charged with ink of a first colour delivered from pump 42 through feed pipe 43, the plug 41 being positioned at the right hand end of the chamber, the ink keys (not shown) being closed and the ink pumps being inoperative, cleaning agent is applied to the back of the plug and serves to drive such plug to the opposite end of the chamber, thereby purging the chamber of any residual ink and returning such ink to the relevant ink reservoir. The ink keys are then opened to allow passage therethrough and on to the ink roller of the cleaning agent. After a requisite period of time the feed of cleaning fluid is discontinued and pressure air is introduced into the chamber to return the plug to the right hand end thereof (FIG. 4*b*), such motion discharging the cleaning agent from the chamber. The pressure air serves also to blow any cleaning agent present in the ink keys from such keys.

The supply of pressure air is discontinued and the valve through which such air passes to the chamber is closed. Pump 44, which delivers Ink of a second colour to the chamber through feed pipe 45, is turned on to charge the chamber with ink of that second colour, and such ink is delivered to and passes through the ink keys (FIG. 4*c*) . After ink feed for a predetermined period of time the cleaning process is completed, and the arrangement readied for printing. It is to be appreciated that suitable valving, for example solenoid controlled valving, will be provided to allow introduction of cleaning fluid and pressure air, as required.

Whilst the concept hereinproposed is intended for use particularly with the ink supply arrangement of the patent application aforesaid, the concept may be applied to any supply arrangement having an ink chamber of substantially uniform cross-section from which ink is fed to the printing roller or to transfer rollers, the plug being of a cross-section corresponding to the transverse cross-section of the chamber.

The invention does enable the recovery of material qualities of ink which would otherwise be discarded, and thus offers significant financial savings. Furthermore, the invention does provide a means whereby colour change or cleaning can be effected in a simple manner with the minimum of machine down-time, such being particularly important in the context of high speed newspaper machines.

We claim:

1. A method of effecting color change in the ink supply system of a printing machine, the ink supply system including an elongate chamber having opposite ends and defining an ink reservoir to which ink is fed from a supply and from which ink is delivered to a printing roller, comprising the following steps:

supplying ink to the opposite ends of the elongate chamber (27) from respective differently colored supplies (12, 13);

providing a plug (41) within the chamber (27), the plug (41) being a close but sliding fit therein; and moving the plug longitudinally of the chamber (27) to purge the chamber of any redundant color and allow feed to said chamber of a replacement color.

2. The method as claimed in claim 1 including the step of applying fluid under pressure to the plug (41) to effect movement thereof longitudinally of the chamber.

3. An ink supply system for a printing machine, the system comprising:

an elongate ink rail;

an elongate ink chamber in said ink rail having opposite ends and extending in a longitudinal direction thereof;

a multiplicity of parallel feed passages in said rail having respective outlet orifices at a common surface of said rail, the feed passages extending between said common surface and said chamber;

an ink supply means (12, 13) for supplying ink to opposite ends of the elongate ink chamber (27); and a plug (41) within said chamber as a close fit therein, the plug being movable longitudinally of said chamber.

4. An ink supply system as claimed in claim 3, further including sealing means (42) on the plug engaging in sealing relationship with the chamber.

5. An ink supply system as claimed in claim 4, wherein the plug (41) has a cylindrical surface with grooves formed therein, and wherein the sealing means comprise O-rings (42) seated in said grooves.

6. An ink supply system as claimed in claim 3, wherein movement of the plug (41) longitudinally of the chamber is pressure fluid induced.

* * * * *